US008959952B2

(12) United States Patent
Darde et al.

(10) Patent No.: US 8,959,952 B2
(45) Date of Patent: Feb. 24, 2015

(54) METHOD FOR SEPARATING A MIXTURE OF CARBON MONOXIDE, METHANE, HYDROGEN AND OPTIONALLY NITROGEN BY CRYOGENIC DISTILLATION

(75) Inventors: Arthur Darde, Paris (FR); Natacha Haik-Beraud, Champigny-sur-Marne (FR); Antoine Hernandez, Le Plessis-Trevise (FR); Guillaume Teixeira, Paris (FR)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 1245 days.

(21) Appl. No.: 12/519,922

(22) PCT Filed: Dec. 14, 2007

(86) PCT No.: PCT/FR2007/052530

§ 371 (c)(1),
(2), (4) Date: Jun. 18, 2009

(87) PCT Pub. No.: WO2008/087318

PCT Pub. Date: Jul. 24, 2008

(65) Prior Publication Data

US 2010/0043489 A1 Feb. 25, 2010

(30) Foreign Application Priority Data

Dec. 21, 2006 (FR) ..... 06 55775
May 16, 2007 (FR) ..... 07 55103

(51) Int. Cl.
*F25J 3/00* (2006.01)
*F25J 3/02* (2006.01)

(52) U.S. Cl.
CPC ..... *F25J 3/0223* (2013.01); *F25J 3/0233* (2013.01); *F25J 3/0252* (2013.01); *F25J 3/0261* (2013.01);

(Continued)

(58) Field of Classification Search
CPC ..... F25J 3/0223; F25J 3/02257; F25J 3/0252; F25J 2205/04; F25J 2270/02; F25J 2270/08
USPC ..... 62/625, 632, 920
See application file for complete search history.

(56) References Cited

U.S. PATENT DOCUMENTS 3,813,889 A * 6/1974 Allam et al. ..... 62/639
4,102,659 A * 7/1978 Martin ..... 62/625

(Continued)

FOREIGN PATENT DOCUMENTS

EP 0928937 7/1999

OTHER PUBLICATIONS

Hausen et al., "Tieftemperaturtechnik" Erzeugung Sehr Tiefer Temperaturen, Basverflussigung Und Zerlegung Von Gasgemischen, Springer-Verlag, 1985, 4 pages.

(Continued)

*Primary Examiner* — Frantz Jules
*Assistant Examiner* — Webeshet Mengesha
(74) *Attorney, Agent, or Firm* — Justin K. Murray

(57) ABSTRACT

The invention relates to a method for separating a mixture comprising at least carbon monoxide, hydrogen, and methane. According to said method, the mixture is separated by a first separating means, at least one liquid fraction of the chamber of the separating means is sent to a product stripper, and at least part of the liquid fraction is sent from the product stripper to a $CO/CH_4$ separating column in order to produce a methane-enriched liquid flow and a gaseous flow enriched with carbon monoxide. The process is carried out under cold conditions at least partially as a result of a carbon monoxide cycle, said cycle at least partially ensuring the condensation at the top of the $CO/CH_4$ separating column and/or the reboiling in the chamber of the product stripper and/or the reboiling in the chamber of the $CO/CH_4$ separating column and/or the cooling of the mixture for the first separating means.

27 Claims, 4 Drawing Sheets

(52) U.S. Cl.
CPC ..... *F25J 2200/70* (2013.01); *F25J 2200/74* (2013.01); *F25J 2205/04* (2013.01); *F25J 2205/30* (2013.01); *F25J 2270/02* (2013.01); *F25J 2270/04* (2013.01); *F25J 2270/08* (2013.01); *F25J 2270/24* (2013.01); *Y10S 62/92* (2013.01)
USPC ..... 62/630; 62/632; 62/625; 62/920

(56) References Cited

U.S. PATENT DOCUMENTS 4,311,496 A * 1/1982 Fabian ..... 62/630
4,478,621 A 10/1984 Fabian
6,062,042 A * 5/2000 McNeil et al. ..... 62/625
6,073,461 A * 6/2000 McNeil et al. ..... 62/625
6,178,774 B1 * 1/2001 Billy et al. ..... 62/620
2006/0074132 A1 * 4/2006 Allam et al. ..... 518/702

OTHER PUBLICATIONS

Vansant et al., "Gas Separation Technology", Dept. of Chemistry, University of Antwerp, 1990, pp. 587-588.
Berninger, "Progress in H2/CO Low-Temperature Separation", Reports on Science and Technology, 44/1988, pp. 18-23.

* cited by examiner

METHOD FOR SEPARATING A MIXTURE OF CARBON MONOXIDE, METHANE, HYDROGEN AND OPTIONALLY NITROGEN BY CRYOGENIC DISTILLATION

This application is a §371 of International PCT Application PCT/FR2007/052530, filed Dec. 14, 2007.

FIELD OF THE INVENTION

The present invention relates to a method for separating a mixture of carbon monoxide, methane, hydrogen and optionally nitrogen by cryogenic distillation.

BACKGROUND

It is known to separate such a mixture in order to produce carbon monoxide and hydrogen by a methane scrubbing process as described in Linde Reports on Science and Technology, "Progress in $H_2$/CO Low-Temperature Separation" by Berninger, 44/1988 and in "A New Generation of Cryogenic $H_2$/CO Separation Processes Successfully in Operation at Two Different Antwerp Sites" by Belloni, International Symposium on Gas Separation Technology, 1989.

Other documents that describe methane scrubbing processes include: EP-A-0928937, U.S. Pat. No. 4,478,621, Tieftemperaturtechnik, page 418.

The carbon monoxide that results from $H_2$/CO cold boxes entrains with it a significant fraction of nitrogen present in the feed gas. This phenomenon is linked to the difficulty in separating the two components CO and $N_2$, their bubble points being very close. Nevertheless, depending on the use which is made of the CO downstream of the cold box, it sometimes proves necessary to reduce its nitrogen content before exporting it.

In order to do this, recourse has conventionally been made to the installation in the cold box of a column known as a denitrogenation column, the role of which is to produce, as bottoms, carbon monoxide at the required purity. At the top of the column, a nitrogen purge is recovered that contains a fraction of CO. The denitrogenation column is installed either upstream, or downstream of the CO/$CH_4$ separation column.

One of the existing processes described in U.S. Pat. No. 4,478,621 comprises a denitrogenation column equipped with an overhead condenser. The refrigerant for the overhead condenser of the denitrogenation column is liquid CO, the pressure of which is close to atmospheric pressure. At this pressure level, the vaporization temperature of the CO is too low to cool the feed gas at the inlet of the methane scrubbing column: the methane would risk freezing. In order to cool the feed gas, the process thus provides a vaporization of CO at a higher pressure level.

SUMMARY OF THE INVENTION

1) The present invention consists in using a single pressure for vaporization of the CO, in order to satisfy the following needs: refrigerant supply to the condenser(s) (of the denitrogenation column and/or of the CO/$CH_4$ separation column) and/or cooling of the feed gas up to the inlet of the methane scrubbing column and/or subcooling of the methane scrubbing column. Considering the constraint on the freezing point of methane, this pressure is around 2.6 bar abs.

2) The invention furthermore consists in using a single CO cycle pressure in order to provide the needs of the reboilers of the flash column and of the CO/$CH_4$ column. This pressure may lie between 25 and 45 bar, preferably between 32 and 45 bar. The placement of these reboilers in the CO circuit may either be in parallel, or in series. This configuration makes it possible to simplify the design of the cycle compressor and of the exchange line.

3) The invention finally consists in supplying the reboiling needs of the denitrogenation column by direct injection of pure CO gas as bottoms, itself derived from the mixture of two (or three) streams:

a) the first stream is derived from the vaporization of liquid CO in the exchange line, at the appropriate temperature and pressure for feeding the denitrogenation column, that is to say at medium pressure (3.5 to 5 bar abs);
b) the second stream is directly derived from the cycle compressor (it is cooled in the exchange line);
c) the third (optional) stream is derived from the exhaust from the CO cryogenic turbine (it is optionally cooled in the exchange line).

The first advantage of the invention is that the lowest vaporization pressure of the CO is around 2.6 bar abs, and the highest pressure around 35 bar abs. This usually makes it possible to provide the compression of the CO cycle by a five-stage (maximum six-stage) centrifugal compressor. In addition, the pressure HP of the cycle corresponds quite well to the pressures of CO produced that are often required (especially for the production of acetic acid).

The second advantage of the invention is that it causes two CO vaporization plateaus to appear in the exchange line: one around 2.6 b, the other around 4 b. This makes it possible to save energy in the CO cycle.

The third advantage of the invention is to provide two, or even three, adjusting levers for the control of the reboiling of the denitrogenation column. In addition, sending medium-pressure carbon monoxide from the turbine to the denitrogenation vessel makes it possible to save a lot on the investment of the heat exchanger 9.

All the pressures mentioned in this document are absolute pressures.

According to one subject of the invention, a method is provided for separating a mixture comprising at least carbon monoxide, hydrogen and methane in which the mixture is separated in a methane scrubbing column, at least one portion of the liquid fraction from the bottom of the methane scrubbing column is sent to a stripping column, at least one portion of the liquid fraction from the stripping column is sent to a CO/$CH_4$ separation column in order to produce a liquid stream enriched in methane and a gas stream enriched in carbon monoxide, at least one portion of the liquid stream is sent to the top of the methane scrubbing column and the gas stream enriched in carbon monoxide is drawn off, the method being kept cold at least partially by a carbon monoxide cycle, said cycle at least partially providing the condensation at the top of the CO/$CH_4$ separation column and/or the reboiling at the bottom of the stripping column and/or the reboiling at the bottom of the CO/$CH_4$ separation column and/or the cooling of the mixture intended for the methane scrubbing column and/or the cooling of the methane intended for the methane scrubbing column.

According to one subject of the invention, it is provided that:

at least two of the following steps:
condensation at the top of the CO/$CH_4$ separation column;
reboiling at the bottom of the stripping column;
reboiling at the bottom of the CO/$CH_4$ separation column;
cooling of the mixture intended for the methane scrubbing column;
cooling of the methane intended for the methane scrubbing column;

cooling of the methane intended for the methane scrubbing column;

subcooling of the methane scrubbing column;

condensation at the top of the denitrogenation column, are carried out at pressures that differ from one another by at most 0.5 bar, or even 0.25 bar.

Optionally, at least two of the following steps:

condensation at the top of the $CO/CH_4$ separation column;

reboiling at the bottom of the stripping column;

reboiling at the bottom of the $CO/CH_4$ separation column;

cooling of the mixture intended for the methane scrubbing column;

cooling of the methane intended for the methane scrubbing column;

cooling of the methane intended for the methane scrubbing column;

subcooling of the methane scrubbing column;

condensation at the top of the denitrogenation column, are carried out at an intermediate pressure of a carbon monoxide compressor.

A carbon monoxide compressor perhaps has an inlet pressure of at least 1.5 bar, optionally of at least 2 bar, and receives the carbon monoxide that originates directly from at least one of the following steps without having been compressed:

condensation at the top of the $CO/CH_4$ separation column;

cooling of the mixture intended for the methane scrubbing column;

cooling of the methane intended for the methane scrubbing column;

subcooling of the methane scrubbing column;

condensation at the top of the denitrogenation column.

Among other optional features:

the mixture also contains nitrogen and the gas stream enriched in carbon monoxide is sent to a denitrogenation column in order to produce a carbon-monoxide-rich liquid stream and a nitrogen-rich gas stream, said carbon monoxide cycle at least partially providing the condensation at the top of the denitrogenation column;

the carbon monoxide of the cycle is compressed to a high pressure by a cycle compressor, then expanded in a turbine and sent in gas form to the bottom of the $CO/CH_4$ separation column;

the carbon monoxide of the cycle is compressed by a cycle compressor to a high pressure, then expanded in a turbine and sent in gas form to the bottom of the denitrogenation column;

the carbon monoxide of the cycle is compressed in a first cycle compressor to a medium pressure and then partly by the cycle compressor to a high pressure and one portion of the carbon monoxide at the medium pressure is sent in gas form to the denitrogenation column;

the carbon monoxide of the cycle is compressed in a first cycle compressor to a medium pressure and then a first portion of the carbon monoxide of the cycle is sent to the bottom of the denitrogenation column and a second portion of the carbon monoxide is compressed to a high pressure;

a CO cycle stream at between 25 and 45 bar, preferably at between 32 and 35 bar, heats the bottom of the stripping column and/or the bottom of the separation column;

a CO cycle stream at between 25 and 45 bar, preferably at between 32 and 35 bar, is expanded to the pressure of the denitrogenation column;

a CO cycle stream at between 3.5 and 5 bar is sent to the bottom of the denitrogenation column;

the CO cycle stream is liquefied then is vaporized in an exchange line and is sent to the bottom of the denitrogenation column;

the mixture to be separated in the methane scrubbing column is cooled by heat exchange with a stream of carbon monoxide of the cycle at at least 2 bar, or even between 2 and 3 bar;

the streams enriched in carbon monoxide at substantially the same pressure, preferably between 2 and 4 bar, or even between 2 and 3 bar, provide at least two of the following functions: supply of refrigeration to the overhead condenser of the denitrogenation column, subcooling of the denitrogenation column and cooling of the scrubbing column.

According to another subject of the invention, an installation is provided for separating a mixture comprising at least carbon monoxide, hydrogen and methane comprising in which a methane scrubbing column, a stripping column and a $CO/CH_4$ separation column, a line for sending the mixture to the methane scrubbing column, a line for sending at least one portion of the liquid fraction from the bottom of the methane scrubbing column to the stripping column, a line for sending at least one portion of the liquid fraction from the stripping column to the $CO/CH_4$ separation column in order to produce a liquid stream enriched in methane and a gas stream enriched in carbon monoxide, a line for sending at least one portion of the liquid stream enriched in methane to the top of the methane scrubbing column and a line for withdrawing the gas stream enriched in carbon monoxide from the $CO/CH_4$ separation column, the installation being kept cold at least partially by a carbon monoxide cycle, said cycle at least partially providing the cooling of an overhead condenser of the $CO/CH_4$ separation column and/or the heating of a bottom reboiler of the stripping column and/or a bottom reboiler of the $CO/CH_4$ separation column.

According to other aspects of the invention, it is provided that the mixture also contains nitrogen and the installation comprises a denitrogenation column and a line for sending the gas stream enriched in carbon monoxide to the denitrogenation column in order to produce a carbon-monoxide-rich liquid stream and a nitrogen-rich gas stream, said carbon monoxide cycle at least partially providing the cooling of an overhead condenser of the denitrogenation column.

The installation may also comprise:

a cycle compressor and a turbine, in which the carbon monoxide of the cycle is compressed to a high pressure by the cycle compressor, then expanded in the turbine and sent in gas form to the bottom of the $CO/CH_4$ separation column;

a cycle compressor and a turbine, in which the carbon monoxide of the cycle is compressed by the cycle compressor to a high pressure, then expanded in the turbine and sent in gas form to the bottom of the denitrogenation column.

The carbon monoxide of the cycle is optionally compressed in a first cycle compressor to a medium pressure and then a first portion of the carbon monoxide of the cycle is sent to the bottom of the denitrogenation column and a second portion of the carbon monoxide is compressed to a high pressure.

The installation may comprise:

a line for sending a CO cycle stream at the highest pressure of the cycle to the bottom reboiler of the stripping column and/or the bottom of the separation column;

a turbine for expanding the CO cycle stream at the highest pressure of the cycle, the outlet of which is connected to the denitrogenation column;

an exchange line and means for sending the CO cycle stream to the exchange line upstream of the denitrogenation column.

The invention will be described in greater detail by referring to the figures which show separation methods according to the invention.

DETAILED DESCRIPTION OF THE INVENTION

Figure 1:
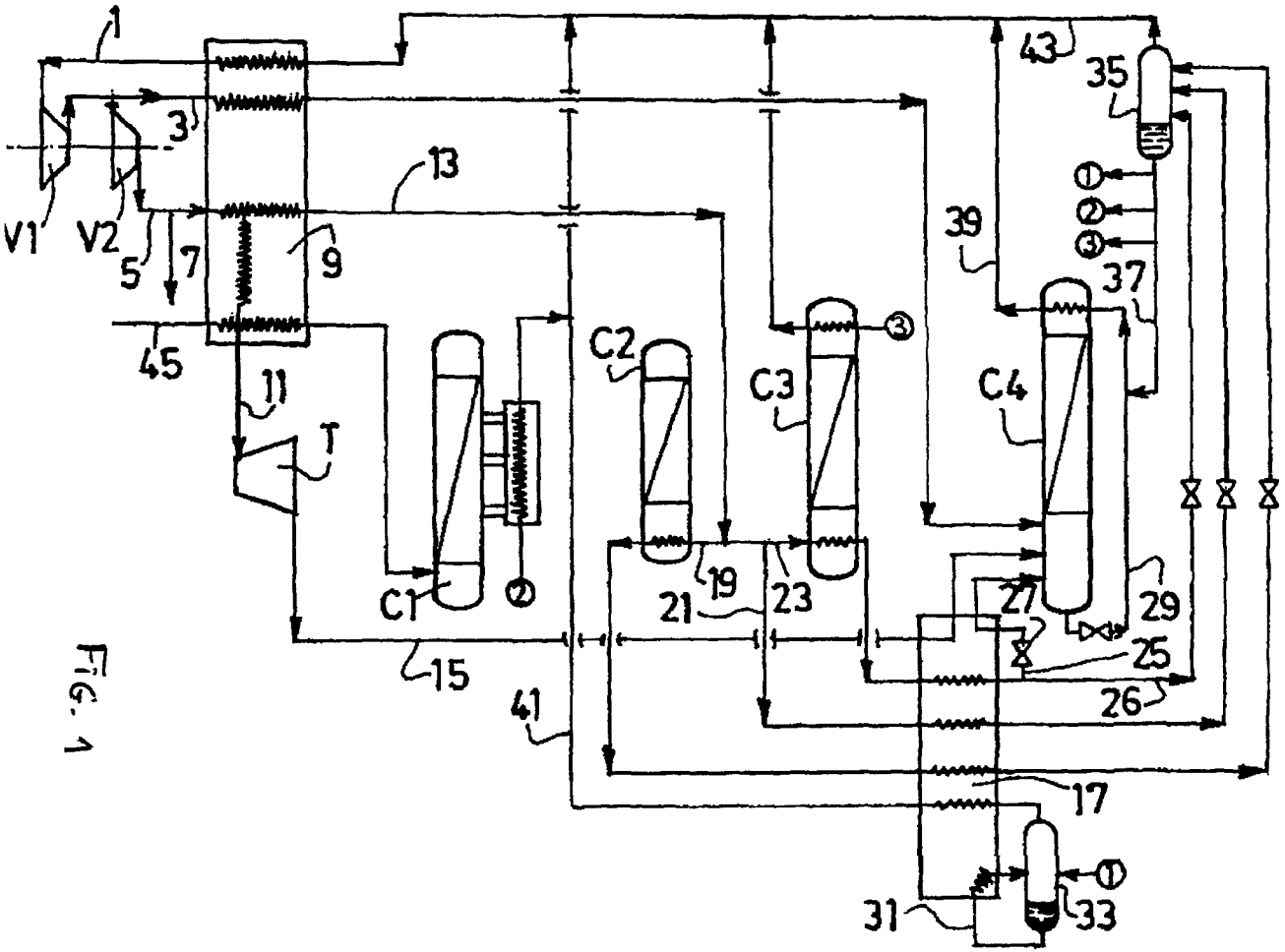
FIG. 1 illustrates one embodiment of the present invention in which only the inlet for the gas to be treated and the carbon monoxide cycle are shown.

For a further understanding of the nature and objects for the present invention, reference should be made to the detailed description, taken in conjunction with the accompanying drawing, in which like elements are given the same or analogous reference numbers and wherein:

In order to simplify FIG. 1, only the inlet for the gas to be treated and the carbon monoxide cycle are shown.

A stream containing carbon monoxide, hydrogen, methane and nitrogen 45 is cooled in the exchanger 9 by heat exchange with a stream of carbon monoxide 1 and is sent to a methane scrubbing column C1 supplied at the top with a stream of liquid methane at very low temperature.

However, it will be understood (although it is not illustrated) that the liquid from the bottom of column C1 is sent to the top of the stripping column C2. The gas from the top of column C that is enriched in hydrogen exits the installation. The liquid from the bottom of the stripping column C2 is sent to a CO/methane separation column C3. The liquid from the bottom of column C3 is sent back to the top of column C1. The gas from the top of column C3 is sent to an intermediate point of the denitrogenation column C4 where it is separated into a bottoms liquid rich in carbon monoxide and an overhead gas rich in nitrogen.

The layout of the columns therefore corresponds to that from FIG. 6 of Linde Reports on Science and Technology, "Progress in $H_2$/CO Low-Temperature Separation" by Berninger, 44/1988. However, the refrigeration production cycle is very different to that from the prior art. The layout by Berninger has two drawbacks relative to that of the invention:

1) One of the fluids supplying the bottom of the denitrogenation column comes from the vaporization of CO in the coolers of the scrubbing column. This means:

a) either that this vaporization of CO is carried out at medium pressure (therefore the temperature of the scrubbing column is not optimal, hence a drop in the efficiency of the scrubbing);

b) or that this vaporization of CO is carried out at low pressure, in this case the scrubbing is optimized, but CO at very low pressure is then required for the condenser of the denitrogenation column (therefore an additional stage for the compressor).

2) The layout by Berninger does not show vaporization of CO at medium pressure in the exchange line. However this vaporization is one of the main advantages of the layout according to the invention, since it makes it possible to optimize the exchange diagram and therefore the overall energy consumption of the method.

A stream of syngas is sent to a methane scrubbing column C1 supplied overhead with a stream of liquid methane 4. The bottoms liquid (not illustrated) is sent to the stripping column C2 in a known manner and a hydrogen-free fluid is sent from the stripping column C2 to the CO/$CH_4$ separation column C3. A stream enriched in carbon monoxide is withdrawn from the top of column C3 and sent to the denitrogenation column C4 to remove the nitrogen therefrom.

A stream of impure carbon monoxide 1 at a low pressure is sent to a compressor stage V1. A portion 3 of the carbon monoxide compressed to between 3.5 and 5 bar, for example 4.3 bar in V1 is cooled in the exchanger 9 and is sent to the bottom of the denitrogenation column C4 in gas form. The rest of the carbon monoxide is compressed again in a compressor V2 to a pressure between 25 and 45 bar, preferably between 32 and 35 bar to form the stream 5. This stream is divided into one portion 7 that constitutes a production and another stream which is sent to the exchanger 9. A fraction 13 passes completely through the exchanger before being divided into three. A first stream 19 is used to reboil the stripping column C2, a second stream 23 is used to reboil the CO/methane column C3 and the two cooled streams 19, 23 are sent with the third stream 21 to an exchanger 17 where they are liquefied. The stream 23 is divided into two, one portion 25 being expanded in a valve 27 then vaporized in the exchanger 17 and sent in gas form to the bottom of the denitrogenation column C4. The rest 26 of the stream 23 is expanded to a pressure of 2.6 bar and sent to a separator pot 35 after expansion in a valve. The streams 21, 19 are also expanded in valves and sent to this same separator pot 35.

It will readily be understood that a portion of one of the streams 19, 21 could be vaporized and sent to the bottom of the denitrogenation column C4 in addition to the stream 25 or instead of this stream 25.

The gas 43 formed in the separator pot 35 is sent back to the compressor V1 after being heated in the exchanger 9.

The liquid from the separator pot 35 is divided into four. One portion 1 is sent to a separator pot 33 where it forms a gaseous fraction 41 and a liquid fraction 31. The liquid fraction 31 is vaporized in the exchanger 17. The gaseous fraction 41 is reheated in the exchanger 17 against the streams 19, 21, 23 before being sent back to the compressor V1.

A portion 2 is used to subcool the methane scrubbing column C1 before being mixed with the stream 41.

A portion 3 is used to condense the top of the CO/methane column C3 where it is vaporized and is then sent back to the compressor V1.

The fourth portion 37 is mixed with the bottoms liquid 29 from the denitrogenation column and is used to cool the top of this column. The stream formed 39 is sent back to the compressor V1.

These four portions 1, 2, 3, 37 are substantially at the same pressure.

Finally, a stream 11 is partially cooled in the exchanger 9, is expanded in a turbine T, is cooled in the exchanger 17 as the stream 15 and is sent to the bottom of the denitrogenation column C4.

Figure 2:
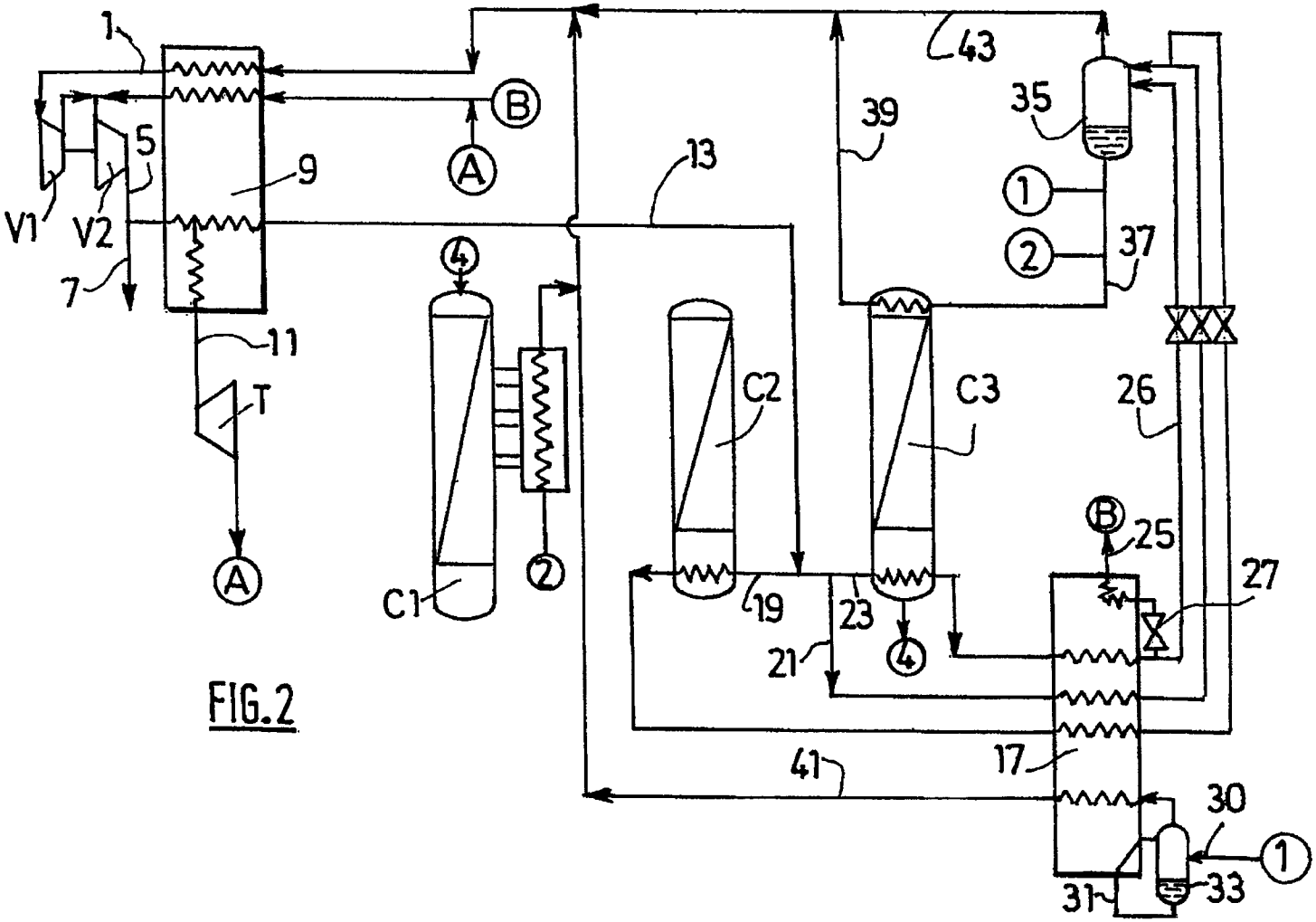
FIG. 2 illustrates one embodiment of the present invention in which only the carbon monoxide cycle is shown.

In FIG. 2, a methane scrubbing column C1, a stripping column C2 and a CO/$CH_4$ separation column C3 are identified. In order to simplify FIG. 2, only the carbon monoxide cycle is shown.

A stream containing carbon monoxide, hydrogen, methane and nitrogen (not illustrated) is cooled in the exchanger 9 by heat exchange with a stream of carbon monoxide 1 and is sent to a methane scrubbing column C1 supplied at the top by a stream of liquid methane at very low temperature.

It will be understood (although it is not illustrated) that the liquid from the bottom of column C1 is sent to the top of the stripping column C2. The gas from the top of column C1 enriched in hydrogen exits the installation. The liquid from the bottom of the stripping column C2 is sent to a CO/methane separation column C3. The liquid from the bottom of the column C3 is sent back to the top of column C1.

A stream of impure carbon monoxide 1 at a low pressure is sent to a compressor stage V1. Mixed with a stream of carbon monoxide, the carbon monoxide originating from stage V1 is compressed again in a compressor V2 to a pressure between 25 and 45 bar, preferably between 32 and 35 bar in order to form the stream 5. This stream is divided into one portion 7 which constitutes a production of high-pressure carbon monoxide and another stream which is sent to the exchanger 9. A fraction 13 passes completely through the exchanger before being divided into three. A first stream 19 is used to reboil the stripping column C2, a second stream 23 is used to reboil the CO/methane column C3 and the two cooled streams 19, 23 are sent with the third stream 21 to an exchanger 17 where they are liquefied. The stream 23 is divided into two, one portion 25 being expanded in a valve 27 then vaporized in the exchanger 17 and sent in gas form to the compressor V2. The rest 26 of the stream 23 is expanded to a pressure of 2.6 bar and sent to a separator pot 35 after expansion in a valve. The streams 21, 19 are also expanded in valves and sent to this same separator pot 35.

The gas 43 formed in the separator pot 35 is sent back to the compressor V1 after being heated in the exchanger 9.

The liquid from the separator pot 35 is divided into three. One portion 1 is sent to a separator pot 33 where it forms a gaseous fraction 41 and a liquid fraction 31. The liquid fraction 31 is vaporized in the exchanger 17. The gaseous fraction 41 is heated in the exchanger 17 against the streams 19, 21, 23 before being sent back to the compressor V1.

A portion 2 is used to subcool the methane scrubbing column C1 before being mixed with the stream 41.

The third portion 37 is used to cool the top of the $CO/CH_4$ column C3. The stream formed 39 is sent back to the compressor V1.

These three portions 1, 2, 37 are substantially at the same pressure.

Finally, a stream 11 is partially cooled in the exchanger 9, is expanded in a turbine T, is heated in the exchanger 9 and rejoins the inlet of the compressor V2.

Figure 3:
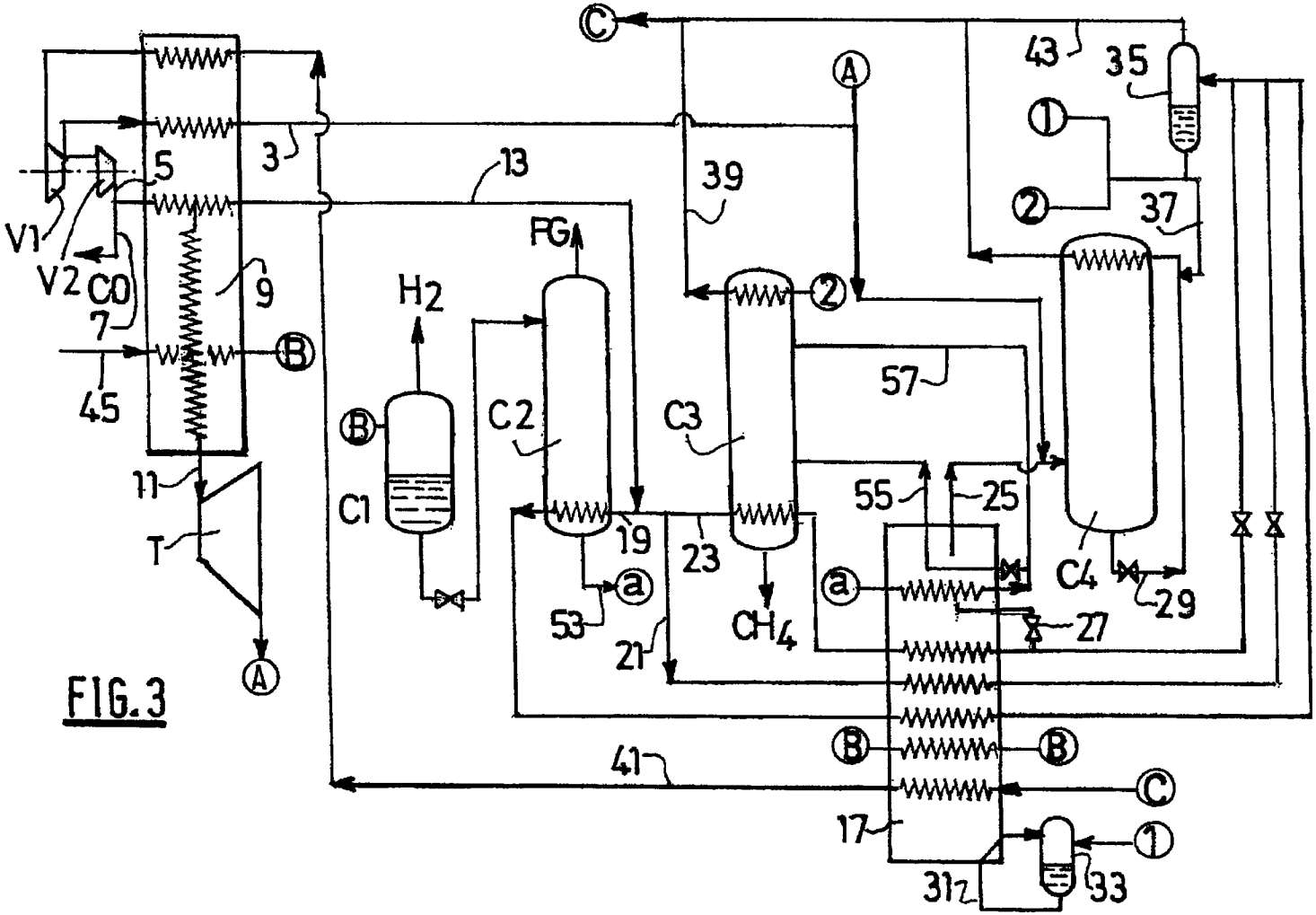
FIG. 3 illustrates one embodiment of the present invention in which only the syngas inlet the carbon monoxide cycle is shown.
Figure 4:
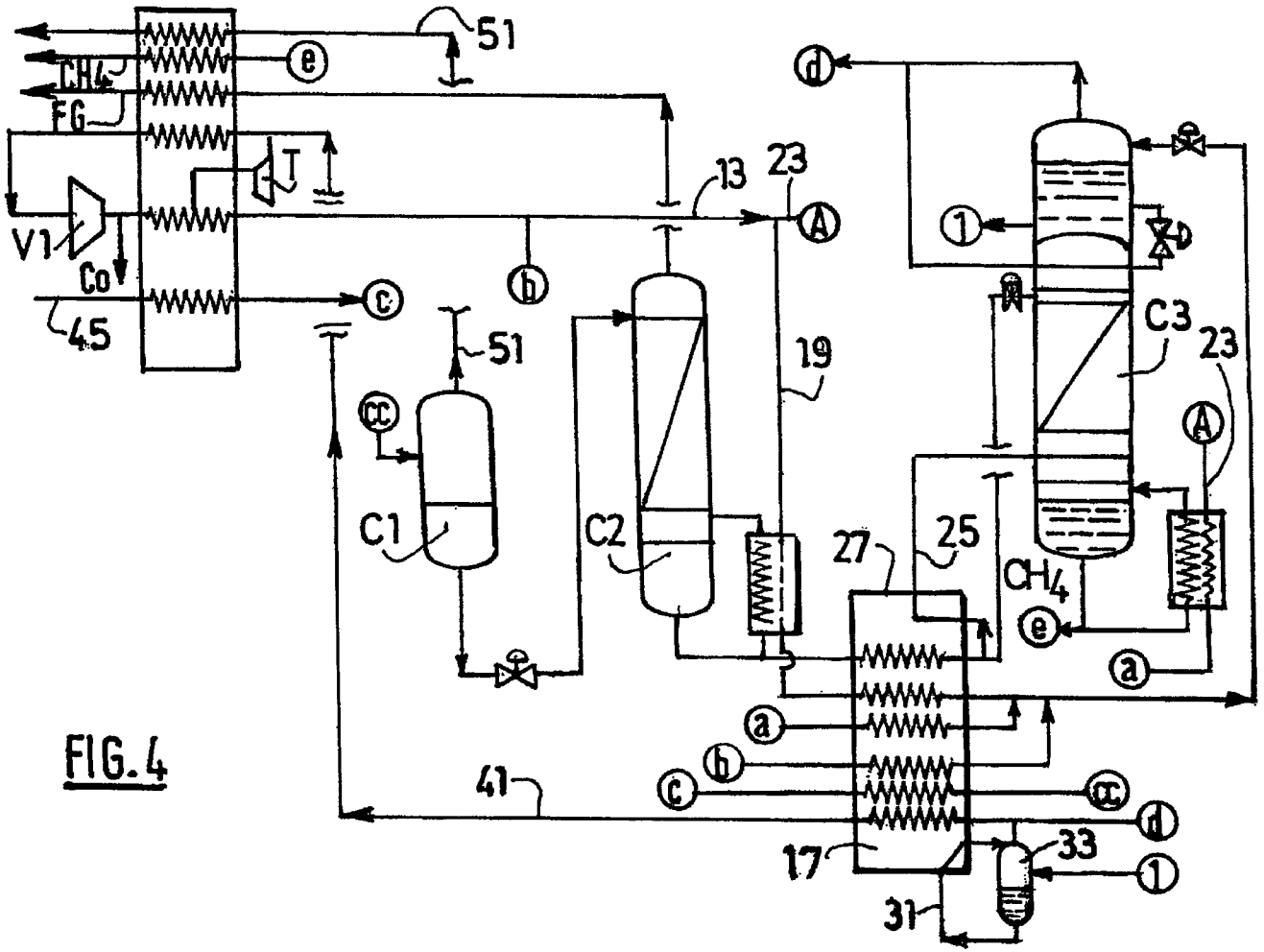
FIG. 4 illustrates another embodiment of the present invention.

In FIG. 3, a separator pot C1, a stripping column C2, a $CO/CH_4$ separation column C3 and a CO denitrogenation column C4 are identified. In order to simplify FIG. 3, only the syngas inlet the carbon monoxide cycle is shown.

A stream 45 containing carbon monoxide, hydrogen, methane and nitrogen is cooled in the exchanger 9 by heat exchange with a stream of carbon monoxide 1 and then in the exchanger 17 and is sent to the separator pot.

The liquid from the bottom of the pot C1 is sent to the top of the stripping column C2. The gas from the top of column C1 enriched in hydrogen exits the installation. The liquid from the bottom of the stripping column C2 is cooled in the exchanger 17 and sent to a CO/methane separation column C3. This bottoms liquid is cooled in the exchanger 17, is divided into two, one portion 57 is sent to the CO/methane separation column and the rest 55 is expanded, heated in the exchanger 17 to an intermediate temperature then sent to the CO/methane separation column C3.

A stream of impure carbon monoxide 1 at a low pressure is sent to a compressor stage V1. The carbon monoxide at medium pressure is divided into two. The stream 3 at medium pressure is cooled in the exchanger 9 and mixed with the carbon monoxide originating from the turbine T and is sent to the bottom of the denitrogenation column C4.

The rest of the carbon monoxide is compressed to a higher pressure in the compressor V2 in order to form the stream 5. One portion 7 of this stream is used as product. The rest is cooled in the exchanger 9. One portion 11 at an intermediate temperature is expanded in a turbine T and sent to the denitrogenation column. A fraction 13 passes completely through the exchanger before being divided into three. A first stream 19 is used to reboil the stripping column C2, a second stream 23 is used to reboil the CO/methane column C3 and the two cooled streams 19, 23 are sent with the third stream 21 to an exchanger 17 where they are liquefied. The stream 23 is divided into two, one portion 25 being expanded in a valve 27 then vaporized in the exchanger 17 and sent in gas form to the denitrogenation column C4. The rest 26 of the stream 23 is expanded to a pressure of 2.6 bar and sent to a separator pot 35 after expansion in a valve. The streams 21, 19 are also expanded in valves and sent to this same separator pot 35.

The gas 43 formed in the separator pot 35 is sent back to the compressor V1 after being heated in the exchanger 9.

The liquid from the separator pot 35 is divided into three. One portion 1 is sent to a separator pot 33 where it forms a gaseous fraction 41 and a liquid fraction 31. The liquid fraction 31 is vaporized in the exchanger 17. The gaseous fraction 41 is heated in the exchanger 17 against the streams 19, 21, 23 before being sent back to the compressor V1.

A portion 2 is used to cool the top of the $CO/CH_4$ column C3. The stream formed 39 is sent back to the compressor V1.

The third portion 37 is used to cool the top of the denitrogenation column C4. The stream formed 39 is sent back to the compressor V1.

These three portions 1, 2, 37 are substantially at the same pressure.

For the figures with a methane scrubbing column, the liquid from the separator pot 35 may also provide the cooling of the methane intended for the scrubbing column C1.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for separating a mixture comprising carbon monoxide, hydrogen, nitrogen and methane, the method comprising the steps of:

introducing the mixture to a first separation means;

introducing at least one liquid fraction from the bottom of the first separation means to a stripping column;

introducing at least one liquid fraction from the stripping column to a $CO/CH_4$ separation column in order to produce a liquid stream enriched in methane and a carbon monoxide enriched gas stream, wherein the carbon monoxide enriched gas stream comprises carbon monoxide and nitrogen;

introducing the carbon monoxide enriched gas stream to a denitrogenation column, the denitrogenation column configured to produce a carbon monoxide rich liquid stream and a nitrogen rich gas stream;

providing refrigeration for the method, at least partially, by a carbon monoxide cycle, said carbon monoxide cycle at least partially providing the condensation at the top of the denitrogenation column, wherein a first portion of the carbon monoxide of the carbon monoxide cycle is compressed in a first cycle compressor to a medium pressure, cooled in an exchange line, and then sent to the bottom of the denitrogenation column to be separated therein; and compressing a second portion of the carbon monoxide to a high pressure to produce a high pressure (HP) carbon monoxide, wherein a first fraction of the HP carbon monoxide is used as product, wherein a second fraction of the HP carbon monoxide is used for at least partially providing at least a source of heat transfer selected from the group consisting of reboiling at the bottom of the stripping column, reboiling at the bottom of the $CO/CH_4$ separation column, and combinations thereof, wherein the medium pressure is at a pressure between about 3.5 bar and about 5 bar, inclusive, wherein the high pressure is at a pressure between about 25 bar and about 45 bar, inclusive.

2. The method of claim 1, in which said carbon monoxide cycle provides a source of heat transfer for the condensation at the top of the $CO/CH_4$ separation column, the reboiling at the bottom of the stripping column, the reboiling at the bottom of the $CO/CH_4$ separation column, and the cooling of the mixture intended for the first separation means.

3. The method of claim 1, wherein a third fraction of the HP carbon monoxide is partially cooled in the exchange line, then expanded in a turbine and sent in gas form to the bottom of the denitrogenation column to be separated therein.

4. The method of claim 1, wherein the second fraction of the HP carbon monoxide is at a pressure between about 25 and about 45 bar, inclusive.

5. The method of claim 3, wherein the third fraction of the HP carbon monoxide is at a pressure between about 25 and about 45 bar, inclusive and is expanded in the turbine to the pressure of the denitrogenation column.

6. The method of claim 1, wherein the first portion of the carbon monoxide is at a pressure between about 3.5 and about 5 bar, inclusive, when the first portion of the carbon monoxide is sent to the bottom of the denitrogenation column to be separated therein.

7. The method of claim 1, wherein the second fraction of the HP carbon monoxide used for at least the source of heat transfer is also vaporized in a second exchange line and is sent to the bottom of the denitrogenation column to be separated therein.

8. The method of claim 1, in which the first separation means is a methane scrubbing column.

9. The method of claim 8, in which the mixture to be separated in the methane scrubbing column is cooled by heat exchange with a stream of carbon monoxide of the carbon monoxide cycle with a pressure of at least about 2 bar.

10. The method of claim 8, in which a stream of carbon monoxide of the carbon monoxide cycle with a pressure of at least about 2 bar provides subcooling of the methane scrubbing column.

11. The method of claim 1, in which the first separation means is a phase separator.

12. The method of claim 1, further comprising the step of cooling the second fraction of the HP carbon monoxide, then expanding the second fraction of the HP carbon monoxide to a low pressure between about 2 and about 4 bar, inclusive, before introduction to a separator pot under conditions effective to create a carbon monoxide gas and a carbon monoxide liquid, wherein the carbon monoxide liquid is used to provide at least two functions selected from the group consisting of supply of refrigeration to an overhead condenser of the denitrogenation column, subcooling of the denitrogenation column, cooling of the scrubbing column, and supply of refrigeration to an overhead condenser of the $CO/CH_4$ separation column.

13. The method of claim 2, in which at least two steps selected from the group consisting of condensation at the top of the $CO/CH_4$ separation column, reboiling at the bottom of the stripping column, reboiling at the bottom of the $CO/CH_4$ separation column, cooling of the mixture intended for the methane scrubbing column, cooling of the methane intended for the methane scrubbing column, subcooling of the methane scrubbing column, condensation at the top of the denitrogenation column; and are carried out at pressures that differ from one another by at most 0.5 bar.

14. The method of claim 2, in which at least two steps selected from the group consisting of condensation at the top of the $CO/CH_4$ separation column, reboiling at the bottom of the stripping column, and reboiling at the bottom of the $CO/CH_4$ separation column, are carried out at an intermediate pressure of a carbon monoxide compressor, wherein the intermediate pressure is at a pressure between an inlet pressure and the high pressure.

15. The method of claim 2, in which a carbon monoxide compressor has an inlet pressure of at least 1.5 bar, and receives the carbon monoxide that originates from at least one of the following steps:

condensation at the top of the $CO/CH_4$ separation column;

cooling of the mixture intended for the methane scrubbing column; or cooling of the methane intended for the methane scrubbing column.

16. An installation for separating a mixture comprising at least carbon monoxide, hydrogen, nitrogen and methane, the installation comprising:

a first separation means;

a stripping column having a bottom reboiler, a $CO/CH_4$ separation column having a bottom reboiler;

a line for sending the mixture to the first separation means;

a line for sending at least one liquid fraction from the first separation means to the stripping column;

a line for sending at least one portion of the liquid fraction from the stripping column to the $CO/CH_4$ separation column in order to produce a liquid stream enriched in methane and a gas stream enriched in carbon monoxide;

a line for withdrawing the gas stream enriched in carbon monoxide from the $CO/CH_4$ separation column;

a first cycle compressor for compressing the carbon monoxide of the cycle to a medium pressure;

a line for sending a first portion of the carbon monoxide of the cycle to the bottom of the denitrogenation column;

a denitrogenation column in fluid communication with the first cycle compressor, the denitrogenation column being configured to receive carbon monoxide from the first cycle compressor at a medium pressure and to remove a substantial portion of nitrogen from the carbon monoxide from the first cycle compressor;

a line for sending the gas stream enriched in carbon monoxide to the denitrogenation column in order to produce a carbon monoxide rich liquid stream and a nitrogen rich gas stream;

a second compressor for compressing a second portion of the carbon monoxide to a high pressure;

wherein the high pressure is between 25 and 45 bar, inclusive;

wherein the medium pressure is between 3.5 and 5 bar, inclusive; and wherein the installation is kept cold at least partially by a cycle of carbon monoxide, said cycle at least partially providing the cooling of an overhead condenser of the denitrogenation column.

17. The installation of claim 16, wherein said carbon monoxide cycle at least partially providing at least one source of heat transfer selected from the group consisting of the condensation at the top of the $CO/CH_4$ separation column, the reboiling at the bottom of the stripping column, reboiling at the bottom of the $CO/CH_4$ separation column, and the cooling of the mixture intended for the first separation means.

18. The installation of claim 16, comprising a cycle compressor and a turbine, in which the carbon monoxide of the cycle is compressed to a high pressure by the cycle compressor, then expanded in the turbine and sent in gas form to the bottom of the $CO/CH_4$ separation column.

19. The installation of claim 16, comprising a cycle compressor and a turbine, in which the carbon monoxide of the cycle is compressed by the cycle compressor to a high pressure, then expanded in the turbine and sent in gas form to the bottom of the denitrogenation column.

20. The installation of claim 16, comprising a line for sending a CO cycle stream at the highest pressure of the cycle to the bottom reboiler of the stripping column and/or to the bottom reboiler of the $CO/CH_4$ separation column.

21. The installation of claim 16, comprising a turbine for expanding the CO cycle stream at the highest pressure of the cycle, the outlet of which is connected to the denitrogenation column.

22. The installation of claim 16, comprising an exchange line and means for sending the CO cycle stream to the exchange line upstream of the denitrogenation column.

23. The installation of claim 16, in which the first separation means is a methane scrubbing column and comprising means for sending a liquid enriched in methane from the $CO/CH_4$ separation column to the scrubbing column.

24. The installation of claim 16, in which the carbon monoxide cycle is connected to an exchanger for cooling the methane intended for the methane scrubbing column.

25. The installation of claim 16, in which the first separation means is a phase separator.

26. The method of claim 1, wherein the carbon monoxide of the carbon monoxide cycle that is compressed in the first cycle compressor to the medium pressure, cooled in the exchange line, and then sent to the bottom of the denitrogenation column to be separated therein is sent from the exchange line to the denitrogenation column without being used for reflux, condenser duties or reboiler duties in between the exchange line and the denitrogenation column.

27. The method of claim 1, wherein the first portion of the carbon monoxide of the carbon monoxide cycle does not change composition when it is compressed in a first cycle compressor, cooled in an exchange line, and then sent to the bottom of the denitrogenation column.

* * * * *